United States Patent [19]

Knapp

[11] 4,224,914

[45] Sep. 30, 1980

[54] FUEL INJECTION APPARATUS

[75] Inventor: Heinrich Knapp, Leonberg, Fed. Rep. of Germany

[73] Assignee: Robert Bosch GmbH, Stuttgart, Fed. Rep. of Germany

[21] Appl. No.: 940,679

[22] Filed: Sep. 8, 1978

[30] Foreign Application Priority Data

Sep. 23, 1977 [DE] Fed. Rep. of Germany ..... 2742797

[51] Int. Cl.[3] ..... F02M 39/00

[52] U.S. Cl. ..... 123/452; 261/44 A; 261/50 A

[58] Field of Search ..... 123/139 AW, 139 BG, 123/139 BC; 261/44 R, 44 A, 50 R, 50 A

[56] References Cited

U.S. PATENT DOCUMENTS

| | | | |
|---|---|---|---|
| 3,688,754 | 9/1972 | Eckert | 123/139 AW |
| 4,043,307 | 8/1977 | Noguchi et al. | 123/139 AW |
| 4,108,117 | 8/1978 | Stumpp et al. | 261/44 R |
| 4,154,203 | 5/1979 | Peters et al. | 123/139 BG |

*Primary Examiner*—Charles J. Myhre
*Assistant Examiner*—Magdalen Moy
*Attorney, Agent, or Firm*—Edwin E. Greigg

[57] ABSTRACT

A fuel injection apparatus for mixture-compressing, externally ignited internal combustion engines with continuous injection into the air induction line adapted to apportion a quantity of fuel proportional to the quantity of induced air and to accomplish good preparation of the fuel-air mixture. The fuel injection apparatus comprises an air flow rate meter arranged in the air induction tube, which moves in accordance with the quantity of air flowing through it against a return force and thereby actuates a fuel apportionment valve. Accordingly, the apportioned fuel flows into a fuel feed line downstream from the fuel apportionment point, which fuel feed line empties on the one side into the air induction line and is connected on the other with a source of air. The pressure differential at the fuel apportionment point is capable of being maintained constant by means of a differential pressure valve, whose movable valve part is acted upon on the one side by the fuel pressure upstream of the fuel apportionment point and on the other side by air pressure in the fuel feed line at the fuel apportionment point. In order to enrich the fuel-air mixture during acceleration, the pressure in the fuel feed line can be expeditiously increased, so that a sufficient pressure differential is available for the injection of the fuel-air mixture at the opening of the fuel feed line into the air induction line.

10 Claims, 6 Drawing Figures

FUEL INJECTION APPARATUS

BACKGROUND OF THE INVENTION

The invention relates to a fuel supply device for mixture-compressing, externally ignited internal combustion engines with a throttle member arranged in the air intake manifold so as to be arbitrarily activatable, and an air metering member, which is deflected against a return force according to the air flow rate and thereby activates a fuel metering device. In addition, the fuel metering device has a control slit, which, in turn, opens a control groove to a greater or lesser degree to meter the fuel and the metered fuel quantity is injected into the air intake manifold, especially by means of a nozzle. A fuel injection apparatus is already known in which a relatively high systemic pressure must be maintained in the fuel system, in order to assure the feed of the apportioned fuel from the apportionment valves to the individual injection points in the induction tube and to assure a proper preparation of the fuel-air mixture. Thus, an expensive fuel pump is required which must generate a relatively high fuel pressure in order to assure proper functioning of the internal combustion engine.

OBJECT AND SUMMARY OF THE INVENTION

The fuel injection apparatus of the present invention has the advantage over the foregoing described structure that a low-pressure fuel injection system can be expeditiously used to feed fuel rapidly to the point where the fuel injection takes place and at the same time can accomplish a very good preparation of the fuel-air mixture.

It is particularly advantageous that the pressure differential at the fuel apportionment point is capable of being maintained constant by a differential pressure valve, the movable valve of which is acted upon on one side thereof by the fuel pressure upstream of the fuel apportionment point and on the other side thereof by the air pressure in the fuel feed line at the fuel apportionment point, so that the fuel apportionment is independent of pressure fluctuations in the air induction line.

A further advantage of the present invention is the assurance of an enrichment of the fuel-air mixture during acceleration of the internal combustion engine.

It is still another advantage of the present invention that an air pump serves as the air source and that the air pressure upstream of the fuel apportionment point is maintained at a constant ratio to the air induction line pressure downstream from the throttle valve.

It is still a further advantage of the present invention that the fuel feed line upstream of the fuel apportionment point is arranged to communicate with the pressure side of a pump which serves as the air source, the induction side of which pump is arranged to communicate with the air induction line downstream of the throttle valve, so that the air used for transport through the fuel feed line is also metered by the air flow rate meter.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
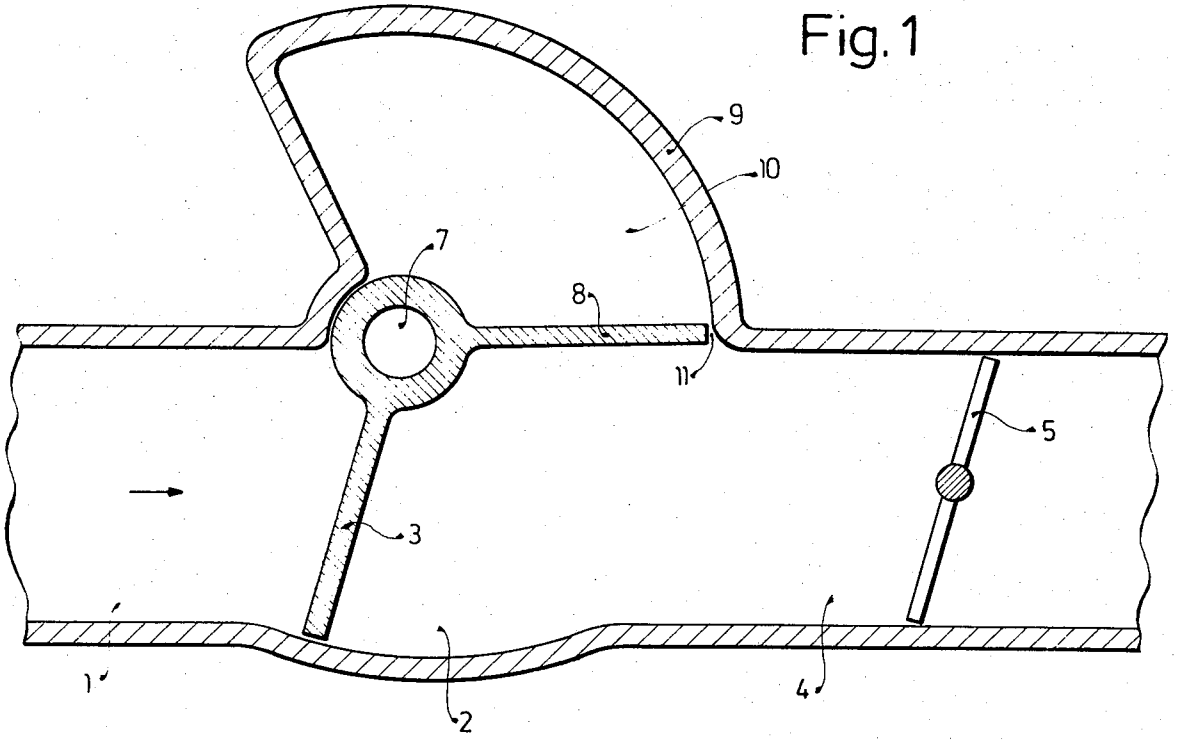
FIG. 1 shows a cross-sectional view of an exemplary embodiment of an air flow rate meter in the air induction line of an internal combustion engine.

Turning now to the view in FIG. 1, the induced air for combustion flows downstream of an air filter (not shown) in the direction of the arrow into an air induction tube section 1, thence into an enlarged section 2 which is integral with the section 1 and includes an air flow rate meter arranged therein which is embodied as barrier valve 3, and further through a section 4 which has an arbitrarily actuatable throttle valve 5 and from there to one or more cylinders (not shown) of an internal combustion engine. The air flow rate meter 3 embodied as the barrier valve moves in the complementally formed section 2 of the air induction line according to an approximately linear function of the air quantity flowing through the air induction line, while at a constant air pressure prevailing in front of the air flow rate meter 3, the pressure prevailing between air flow rate meter and throttle valve 5 likewise remains constant. The air flow rate meter 3 is firmly connected to a bearing shaft 7 which is fixed in an enlarged area of the air induction line with said bearing arranged to extend transversely of the air induction line. It will be noted that the aforesaid air flow rate meter 3 is also provided with a damping valve 8 which is arranged for swinging into a damping section 9 of the air induction line, at which time barrier valve 3 will lie substantially in the plane of the wall which adjoins the damping section 9. The chamber 10 formed by the damping valve 8 and the damping section 9 communicates via a small gap 11 between the front face of the damping valve 8 and the wall of the damping section 9 with the air induction line downstream of the air flow rate meter 3. By means of the damping valve 8 any pressure fluctuations caused by the induction strokes are prevented from having any appreciable influence on the angle of attitude of the air flow rate meter.

Figure 2:
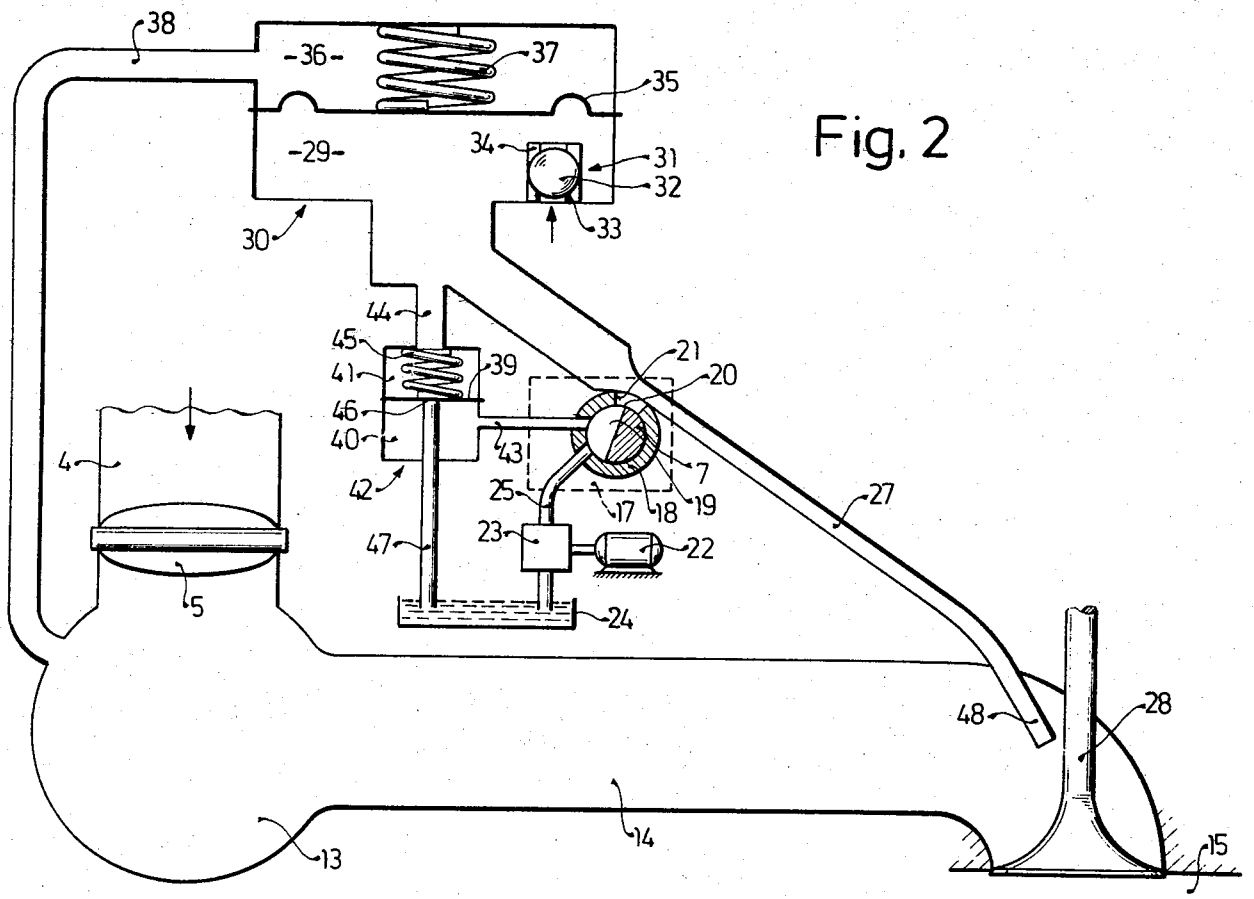
FIG. 2 shows a schematic view of the first embodiment of a fuel injection apparatus.

As is shown in FIG. 2, the air required for combustion flows downstream of the throttle valve 5 into a collective induction line 13 and from there via individual separate air induction line sections 14 to each of the individual cylinders 15 of the internal combustion engine, only the inlet valve 28 of which is shown.

The movable part of a fuel apportionment valve 17, shown in dashed lines, can be activated either directly or via a coupling by means of the bearing shaft 7 of the air flow rate meter 3. Thus, for example, in the present embodiment, the bearing shaft 7 projects out of the air induction line and is rotatably fixed on a sleeve 18 in the interior of the housing of the fuel apportionment valve 17. Control grooves 19 are cut into the bearing shaft 7 each of which has a control edge 20, and according to the rotary position of bearing shaft 7 this control edge will open more or less widely a radial control slit 21 provided in the sleeve 18. The fuel supply of the fuel apportionment valve 17 takes place by means of a fuel pump 23 driven by an electromotor 22, which pump 23 induces fuel from a fuel container 24 and delivers it to the control groove 19 within the fuel apportionment valve 17 via a fuel line 25. Downstream of the fuel apportionment point 19, 20, 21 the apportioned fuel flows into a fuel feed line 27, which discharges into the air induction line section 14 in the immediate vicinity of the inlet valve 28 of each cylinder 15. Upstream of the fuel apportionment point 19, 20, 21 the fuel feed line 27 communicates with a chamber 29 of an acceleration enrichment indicator 30, whcih has an aeration valve 31. The aeration valve 31 can be formed, for example, by a ball element 32 embodied as the movable valve part, which cooperates with a fixed valve seat 33 and which, when the valve opens, is guided in a cage 34, so that air can proceed from an air source via the interior of the chamber 29 into the fuel feed line 27. Either the atmosphere or the air induction tube section 1 which is provided between air filter and air flow rate meter 3 can serve as the air source. The chamber 29 of the acceleration enrichment indicator 30 is separated by a movable member, particularly a diaphragm 35, from another chamber 36. This other chamber 36 includes a pressure spring 37 which acts upon the diaphragm 35 and is also arranged to communicate with the air induction line section 13 downstream of the throttle valve 5 via an underpressure line 38, all of which is clearly shown in FIG. 2. The apportionment of the fuel supply at the fuel apportionment valve 17 takes place at a constant pressure differential. To this end, a chamber 41 of a differential pressure valve 42, which chamber 41 is separated from a chamber 40 by a diaphragm 39, communicates via a line 44 with the fuel feed line 27 upstream of the fuel apportionment point 19, 20, 21, so that the same pressure prevails in the chamber 41 as that pressure which is downstream of the control slit 21. The differential pressure valve 42 is urged in the closing direction by a spring 45, which is arranged in the chamber 41. The force of the spring 45 can be varied in a manner which is per se known in accordance with the operating characteristics of the internal combustion engine. The diaphragm 39 serves as the movable valve part of the differential pressure valve 42 which is embodied as a flat-seat valve. The diaphragm 39 is arranged to cooperate with a fixed valve seat 46, over which fuel can enter a return flow line 47, which empties into the fuel container 24.

The mode of operation of the fuel injection apparatus shown in FIG. 2 is as follows:

In accordance with the induced air quantity, the air flow rate meter 3 is diverted against the force of a return spring (not shown), by which means the bearing shaft 7 rotates with respect to the sleeve 18 of the fuel apportionment valve 17, and the control edge 20 of the control groove 19 opens an appropriate section of the control slit 21, so that a fuel quantity proportional to the induced air quantity can be apportioned. Now, in order to bring the fuel, which has been drawn at the lowest possible pressure and apportioned at the fuel apportionment point 19, 20, 21, as rapidly as possible to the fuel injection point in the air induction line 14 and at the same time to improve the fuel preparation, the apportioned fuel proceeds downstream of the fuel apportionment point into the fuel feed line 27, in which, as a result of the pressure differential prevailing at the two ends of the fuel feed line, a constant flow in the direction of the air induction line section 14 prevails. The apportioned fuel is carried along in the fuel feed line 27 by this air stream and is injected via an injection jet 48 into the air induction line section 14 in close proximity to the inlet valve 28. In this way, an excellent preparation of the apportioned fuel with air results. Fluctuations of the pressure in the air induction line have no influence on fuel apportionment, because of the arrangement of the differential pressure valve 42 on the fuel apportionment valve 17. In order to assure a correct injection of the fuel via the injection jet 48 during the course of an acceleration of the internal combustion engine as well, when the pressure in the air induction line sections 13 and 14 rises as a result of the opening of the throtle valve 5, the acceleration enrichment indicator 30 is provided. The diaphragm 35 of this indicator performs a pumping action in the direction of a reduction in size of the chamber 29 in response to a sudden pressure rise in the collective induction line 13, so that the ball element 32 of the aeration valve 31 is pressed onto the valve seat 33 and a pressure rise quickly appears in the chamber 29 and thus in the fuel feed line 27. Also a sufficiently large pressure differential is available for the transport of the apportioned fuel over the fuel feed 27 into the air induction line 14. The ball element 32 of the aeration valve 31 is advantageously embodied as a plastic ball element of low specific gravity, so that the pressure drop at the aeration valve is as small as possible compared with the pressure drop at the air flow rate meter, and the valve cross-sectional area is as large as possible compared with an idling by-pass which bypasses the throttle valve during idling.

Figure 3:
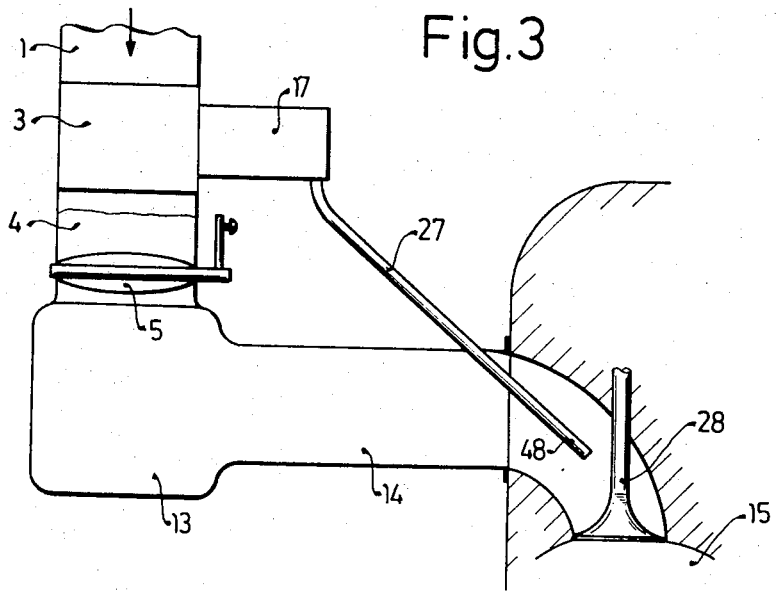
FIG. 3 shows generally a fragmentary side elevational view of an air flow rate meter, throttle valve induction tube and a fuel feed line extending into a cylinder intake port.
Figure 4:
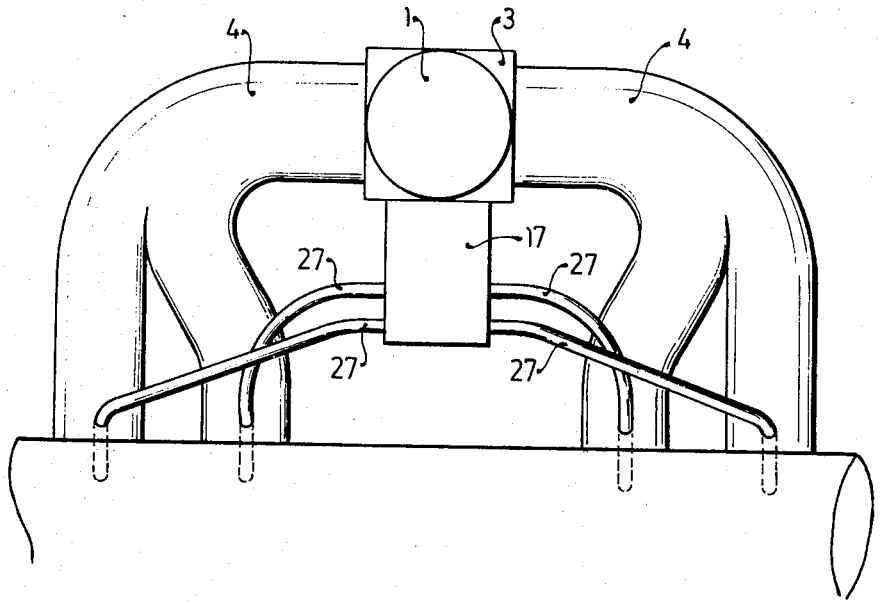
FIG. 4 is a top plan view of the apparatus of FIG. 3.

FIGS. 3 and 4 show the arrangement of the air flow rate meter 3, the fuel apportionment valve 17, and the fuel feed lines 27 at the air induction line 1 and on the internal combustion engine respectively. In order to improve the transport of the apportioned fuel quantity it can likewise be useful to provide the fuel feed lines 27 each with a constant gradient down to the injection point as shown.

Figure 5:
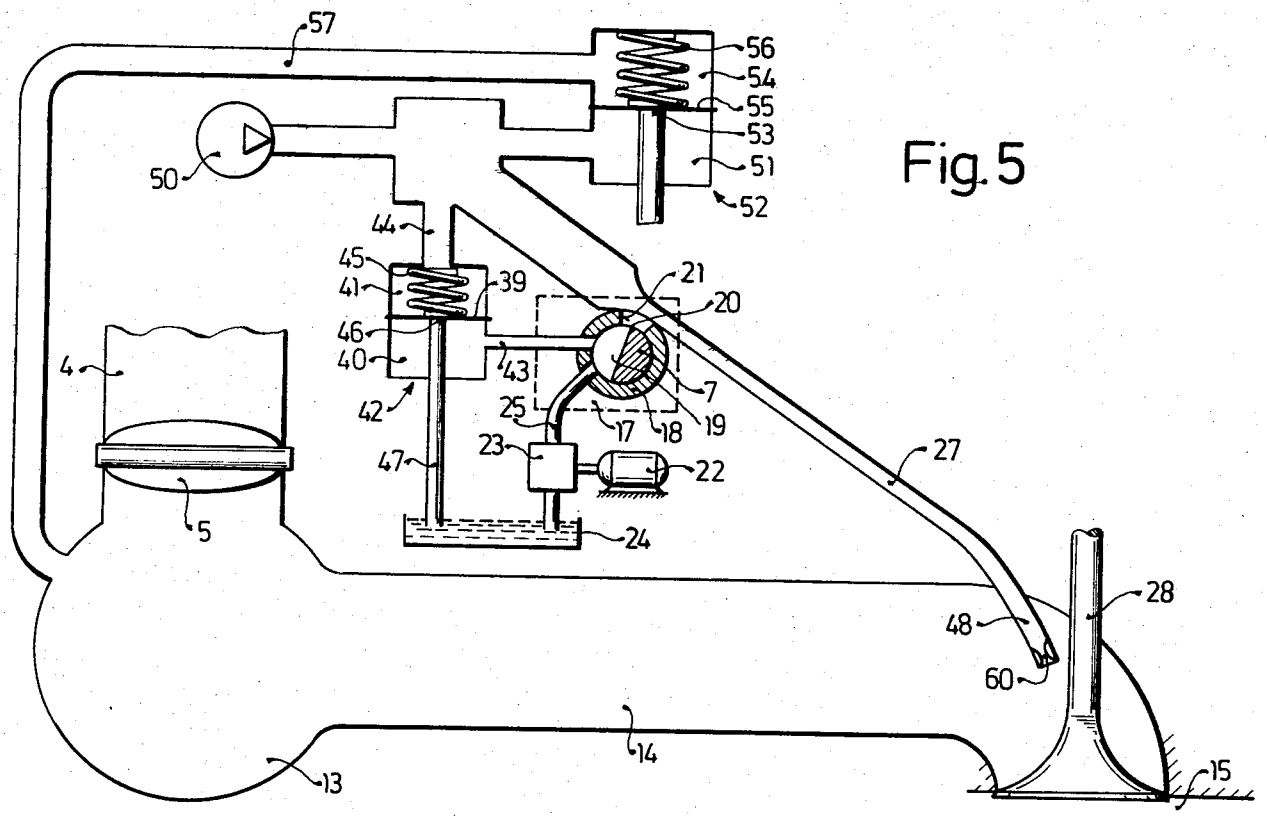
FIG. 5 shows a schematic view of a second embodiment of the fuel injection apparatus.

In the fuel injection apparatus shown in FIG. 5, the parts which remain the same as in the previous figures are provided with the same reference numerals. To assure a pressure differential which remains constant in the fuel feed line 27 at ca. 0.5 bars, the fuel feed line 27 in the exemplary embodiment of FIG. 5 communicates upstream of the fuel apportionment point 19, 20, 21 with an air pump 50 as the air source and with a first chamber 51 of an air differential pressure valve 52. The chamber 51 has a valve seat 53, which is controlled by a diaphragm 55 which separates the first chamber 51 from a second chamber 54. A spring 56 is arranged in the second chamber 54 and urges the diaphragm 55 in the closing direction of the air differential pressure valve 52. The chamber 54 communicates via an underpressure line 57 that leads to the collective air induction line section 13 downstream of the throttle valve 5. Thus, by way of the fixed valve seat 53 of the air differential pressure valve 52, air can escape into the atmosphere when the differential pressure is too great. By providing a throttle point or restrictive means 60 adjacent to the terminus of the injection jet 48, a further improvement of the preparation of the fuel-air mixture can be attained. The use of an air pump 50 as the air source offers the advantage that even in the full-load condition of the internal combustion engine a sufficient pressure gradient is available for the transport of the apportioned fuel.

Figure 6:
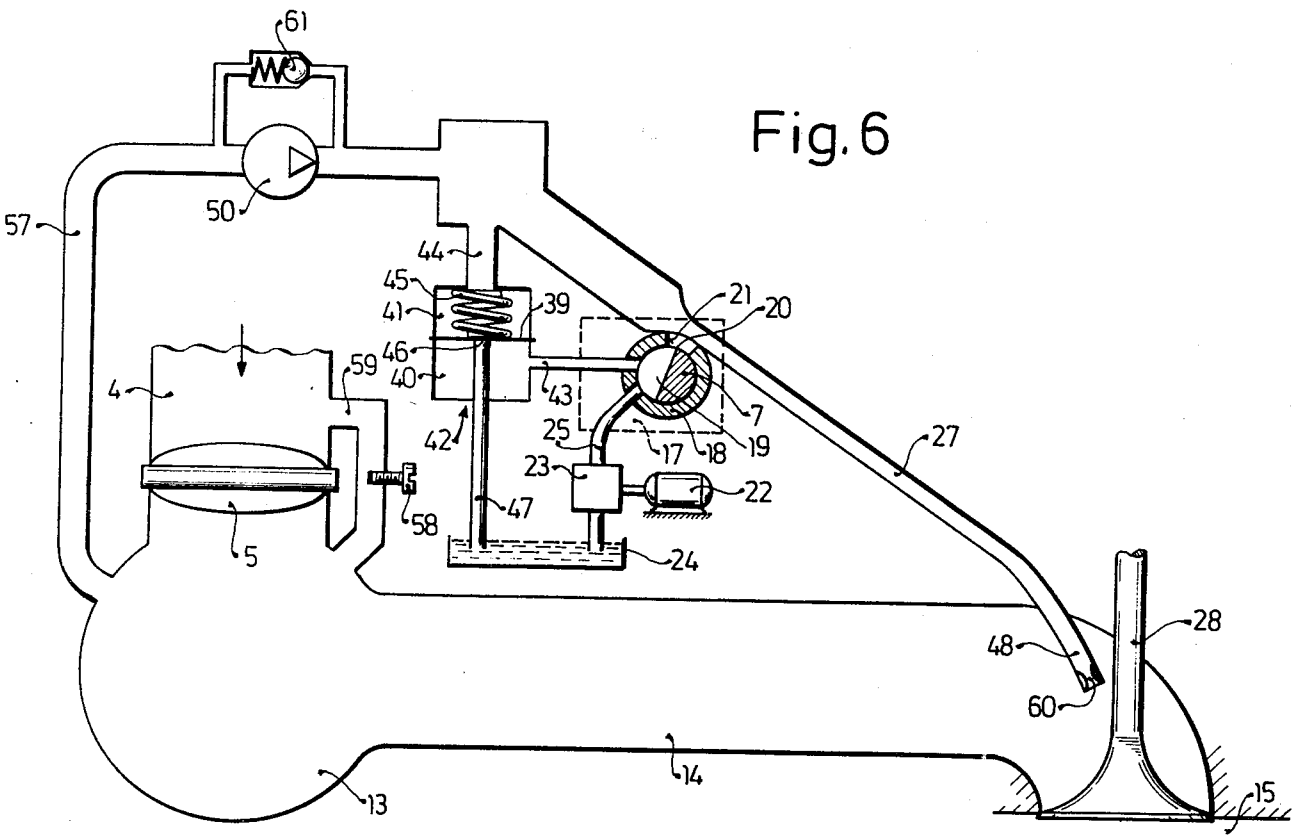
FIG. 6 shows a schematic view of a third embodiment of the fuel injection apparatus.

In FIG. 6, as in the other embodiments disclosed, the elements which are the same as those in the other figures have the same reference numerals. Accordingly, in the exemplary embodiment shown in FIG. 6 as well, an air pump 50 serves as the air source, the pressure side of which is connected to the fuel feed 27 upstream of the fuel apportionment point 19, 20, 21. In contrast to the exemplary embodiment of FIG. 5, however, the induction side of the air pump 50 is connected via the underpressure line 57 to the collective air induction line 13 downstream of the throttle valve 5, and the idling air quantity is determined by means of a by-pass 59, the cross-sectional area of which is variable by means of a screw 58. This arrangement produces the advantage that the entire air quantity delivered to the internal combustion engine is apportioned by the air flow rate meter and no air quantity is delivered to the engine which by-passes the air flow rate meter. In this exemplary embodiment the air pump operates at a variable induction tube pressure, which however has no influence on the fuel apportionment because of the arrangement of the differential pressure valve 42 on the fuel apportionment valve 17.

A pressure-limiting valve 61 disposed above the air pump 50 assures that the air pressure generated in the fuel feed line does not become too high, in the event that the air pump is motor-driven.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection apparatus for mixture-compressing, externally ignited internal combustion engines having air induction tube means into which continuous injection is maintained, the air induction tube means being connected to each engine cylinder; the apparatus including: an arbitrarily actuatable throttle valve mounted in the air induction tube means; a fuel apportionment valve having a movable part partly defining a fuel apportionment point; a fuel line connected to the fuel apportionment valve through which fuel is delivered to the fuel apportionment valve for apportionment past the fuel apportionment point; and a metering device mounted to extend into the air induction tube means upstream of the throttle valve and to move in response to the air quantity flowing through the air induction tube means, the metering device being connected to the fuel apportionment valve to control the fuel apportionment valve in accordance with the air quantity flowing through the air induction tube means, so that the fuel apportionment at the fuel apportionment point is a function of the air quantity flowing through the air induction tube means, the improvement comprising:

a source of pressurized air;

at least one fuel feed line connected at one end to the source of pressurized air, situated at its other end in the air induction tube means adjacent the inlet valve of one of the engine cylinders, and connected between its ends to the fuel apportionment point from which metered fuel is received for transport to said other end of the fuel feed line; and a differential pressure valve connected to the fuel apportionment valve for maintaining the pressure differential at the fuel apportionment point constant, said differential pressure valve having a movable valve part with opposed sides, one of said opposed sides being exposed to the fuel pressure upstream of the fuel apportionment point and the other of said opposed sides being exposed to the air pressure in the fuel feed lines.

2. The improved fuel injection apparatus as defined in claim 1, wherein the source of pressurized air provides atmospheric air to the fuel feed lines.

3. The improved fuel injection apparatus as defined in claim 2, wherein that end of said at least one fuel feed line connected to the source of pressurized air is connected to the air induction tube means upstream of that portion of the metering device which extends into the air induction tube means.

4. The improved fuel injection apparatus as defined in claim 1, wherein the improvement further comprises:

an acceleration enrichment indicator having a movable member, two chambers separated by the movable member, a spring mounted in one of said chambers for biasing the movable valve member in the direction of the other of said chambers, and an aeration valve connected to the source of pressurized air and to the other of said chambers, and wherein said one of said chambers is connected to the fuel feed lines upstream of the fuel apportionment point, and the other of said chambers is connected to the air induction tube means downstream of the throttle valve.

5. The improved fuel injection apparatus as defined in claim 4, wherein the aeration valve comprises a guide cage defining a valve seat and a ball valve which cooperates with the valve seat.

6. The improved fuel injection apparatus as defined in claim 5, wherein the ball valve is plastic.

7. The improved fuel injection apparatus as defined in claim 1, wherein the source of pressurized air comprises an air pump, and wherein the improvement further comprises:

an air differential pressure valve having a movable valve member, two chambers separated by the movable valve member, a spring mounted in one of said chambers for biasing the movable valve member in the direction of the other of said chambers, and means defining a valve seat in the other of said chambers against which the movable valve member is biased by the spring, and wherein said one of said chambers is connected to the air induction tube means downstream of the throttle valve, and the other of said chambers is connected to the air pump.

8. The improved fuel injection apparatus as defined in claim 1, wherein the source of pressurized air comprises an air pump connected on its suction side to the air induction tube means downstream of the throttle valve, and on its pressure side to the fuel feed lines upstream of the fuel apportionment point.

9. The improved fuel injection apparatus as defined in claim 1, wherein the end of each fuel feed line adjacent the inlet valve of a corresponding engine cylinder includes throttle means.

10. The improved fuel injection apparatus as defined in claim 1, wherein each fuel feed line is oriented between its ends to have a constant gradient.

* * * * *